US009890951B2

(12) United States Patent
Wang

(10) Patent No.: US 9,890,951 B2
(45) **Date of Patent: *Feb. 13, 2018**

(54) ALL AROUND RADIATION HEATING APPARATUS

(71) Applicant: Changzhou Gardensun Furnace Co., Ltd., Changzhou (CN)

(72) Inventor: Jianping Wang, Changzhou (CN)

(73) Assignee: CHANGZHOU GARDENSUN FURNACE CO., Changzhou, Jiangsu (CN)

( * ) Notice: Subject to any disclaimer, the term of this patent is extended or adjusted under 35 U.S.C. 154(b) by 193 days.

This patent is subject to a terminal disclaimer.

(21) Appl. No.: 15/082,755

(22) Filed: Mar. 28, 2016

(65) Prior Publication Data

US 2016/0252245 A1 Sep. 1, 2016

Related U.S. Application Data

(63) Continuation of application No. 12/314,273, filed on Dec. 8, 2008, now Pat. No. 9,328,927.

(60) Provisional application No. 61/136,549, filed on Sep. 12, 2008.

(51) Int. Cl.

| | |
|---|---|
| ***F24C 15/22*** | (2006.01) |
| ***F23D 14/14*** | (2006.01) |
| ***F24C 3/04*** | (2006.01) |
| ***F24C 1/12*** | (2006.01) |

(Continued)

(52) U.S. Cl.

CPC ..... *F23D 14/145* (2013.01); *F23D 14/14* (2013.01); *F23D 14/28* (2013.01); *F24C 1/12* (2013.01); *F24C 3/04* (2013.01); *F23D 2203/005* (2013.01); *F23D 2203/102* (2013.01); *F23D 2203/1012* (2013.01); *F24C 5/00* (2013.01)

(58) Field of Classification Search

CPC ..... F24C 3/04; F24C 15/22; F24C 5/00
USPC ..... 126/92 AC, 92 B, 92 R, 92 A
See application file for complete search history.

(56) References Cited

U.S. PATENT DOCUMENTS

| | | | | |
|---|---|---|---|---|
| 2,016,013 | A * | 10/1935 | Kranzlein | C09B 19/02 544/74 |
| 5,992,158 | A | 7/1999 | Culp et al. | |
| 5,964,233 | A | 10/1999 | Clark et al. | |

(Continued)

FOREIGN PATENT DOCUMENTS

| | | |
|---|---|---|
| WO | WO 00/08965 | 2/2000 |
| WO | WO 00/17580 | 3/2000 |

(Continued)

*Primary Examiner* — Gregory Huson
*Assistant Examiner* — Nikhil Mashruwala
(74) *Attorney, Agent, or Firm* — Lau & Associates, LLC

(57) ABSTRACT

The present invention provides a safer all-around radiation heating assembly than similar traditional heaters. As typical with traditional heaters, a shroud is used to surroundably cover a portable liquid propane tank. To replace the portable liquid propane tank, the shroud must be continuously raised to a predetermined height while a service person accesses the propane tank. There is a danger that if and when the shroud drops, a spark could be created resulting in igniting highly flammable escaped propane gas. The present invention overcomes dangers associated with the traditional heaters by eliminating the spark creation danger and by introducing a ventilation system to allow any leaked propane gas to escape away from the heater.

19 Claims, 17 Drawing Sheets

(51) Int. Cl.
*F23D 14/28* (2006.01)
*F24C 5/00* (2006.01)

(56) References Cited

U.S. PATENT DOCUMENTS

| | | | | |
|---|---|---|---|---|
| 6,076,546 | A | 6/2000 | Waters | |
| D429,324 | S | 8/2000 | Olson et al. | |
| 6,102,031 | A | 8/2000 | Waters | |
| 6,164,273 | A | 12/2000 | Waters | |
| 6,192,878 | B1 | 2/2001 | Waters | |
| D445,889 | S | 7/2001 | Resmo et al. | |
| D447,796 | S | 9/2001 | Resmo et al. | |
| D450,816 | S | 11/2001 | Bilotti | |
| 6,446,623 | B1 * | 9/2002 | Resmo | F24C 1/12 126/92 R |
| 6,470,877 | B1 | 10/2002 | Waters | |
| D466,993 | S | 12/2002 | Chang | |
| 6,507,012 | B1 | 1/2003 | Medard et al. | |
| D471,622 | S | 3/2003 | Bossler | |
| D471,967 | S | 3/2003 | Bossler | |
| D472,623 | S | 4/2003 | Bossler | |
| D474,532 | S | 5/2003 | Chan et al. | |
| 6,598,990 | B2 | 7/2003 | Li | |
| 6,619,281 | B2 | 9/2003 | Resmo et al. | |
| 6,650,830 | B2 | 11/2003 | Kerec | |
| 6,651,647 | B2 | 11/2003 | Waters | |
| 6,668,818 | B2 | 12/2003 | Bossler | |
| D486,211 | S | 2/2004 | Chan et al. | |
| D486,567 | S | 2/2004 | Sakai | |
| 6,736,132 | B2 | 5/2004 | Schlosser et al. | |
| 6,742,814 | B2 | 6/2004 | Resmo et al. | |
| 6,745,759 | B2 | 6/2004 | Bossler | |
| 6,792,937 | B2 | 9/2004 | Resmo et al. | |
| 6,907,875 | B1 | 6/2005 | Eastman, II et al. | |
| D509,291 | S | 9/2005 | Cunningham et al. | |
| 7,003,217 | B2 | 2/2006 | Bachinski et al. | |
| 7,086,396 | B2 | 8/2006 | Waters | |
| D532,500 | S | 11/2006 | Yeung | |
| D532,501 | S | 11/2006 | Giovino | |
| 7,175,424 | B2 | 2/2007 | Frink et al. | |
| 7,278,418 | B2 | 10/2007 | Duphily et al. | |
| 7,296,522 | B1 | 11/2007 | Mahmalji | |
| 7,614,600 | B1 | 11/2009 | Smith et al. | |
| 8,176,910 | B2 * | 5/2012 | O'Connell | F24C 1/10 126/92 AC |
| 8,461,494 | B2 * | 6/2013 | Hall, Jr. | F24C 7/105 219/536 |
| 2001/0037804 | A1 | 11/2001 | Waters et al. | |
| 2002/0088454 | A1 | 7/2002 | Resmo et al. | |
| 2002/0089178 | A1 | 7/2002 | Resmo et al. | |
| 2003/0029438 | A1 | 2/2003 | Bossler | |
| 2003/0029439 | A1 | 2/2003 | Bossler | |
| 2003/0056783 | A1 | 3/2003 | Bossler | |
| 2003/0067765 | A1 | 4/2003 | Li | |
| 2003/0099468 | A1 | 5/2003 | Kerec | |
| 2003/0136396 | A1 | 7/2003 | Resmo et al. | |
| 2004/0011346 | A1 | 1/2004 | Sakai | |
| 2004/0226551 | A1 | 11/2004 | Duphily et al. | |
| 2004/0261780 | A1 | 12/2004 | Frink et al. | |
| 2005/0105898 | A1 | 5/2005 | Bachinski et al. | |
| 2005/0175950 | A1 | 8/2005 | Waters | |
| 2005/0247074 | A1 | 11/2005 | Ellicott | |
| 2006/0198084 | A1 | 9/2006 | Hall, Jr. et al. | |
| 2007/0101983 | A1 | 5/2007 | Yao | |
| 2007/0267399 | A1 | 11/2007 | Flores | |
| 2007/0269758 | A1 | 11/2007 | Hofbauer et al. | |
| 2008/0006263 | A1 | 1/2008 | Seichei et al. | |
| 2008/0152329 | A1 | 6/2008 | Saunders et al. | |
| 2009/0223512 | A1 | 9/2009 | Konkle | |
| 2016/0138828 | A1 * | 5/2016 | Merritt | F24C 1/12 126/72 |
| 2017/0102150 | A1 * | 4/2017 | Kalyanaraman | F24C 3/103 |

FOREIGN PATENT DOCUMENTS

| | | |
|---|---|---|
| WO | WO 01/45854 | 6/2001 |
| WO | WO 02/24019 | 3/2002 |
| WO | WO 02/073092 | 9/2002 |
| WO | WO 2004/023954 | 3/2004 |
| WO | WO 2004/082376 | 9/2004 |
| WO | WO 2004/099674 | 11/2004 |
| WO | PCT/GB05/000177 | 4/2005 |
| WO | WO 2005/071321 | 8/2005 |
| WO | WO 2005/072209 | 8/2005 |
| WO | WO 2006/017003 | 2/2006 |
| WO | WO 2006/024916 | 3/2006 |
| WO | WO 2007/001364 | 1/2007 |

* cited by examiner

ALL AROUND RADIATION HEATING APPARATUS

BACKGROUND OF THE INVENTION

The present invention is an all around radiation heating apparatus using propane gas as an energy source of heat generation. To make the heater usable under all outdoor weather conditions, propane gas is stored and supplied, for example, through a portable liquid propane gas tank.

U.S. Pat. Nos. 6,651,647 and 6,470,877 both disclose a heating apparatus. A defining characteristic of these patents is a shroud slidable along a longitudinal tubular shaft. To install or remove a portable liquid propane tank, one has to slide the shroud upward along the longitudinal tubular shaft so as to make the liquid propane tank and the housing chamber thereof accessible.

This system of installing and removing a portable liquid propane tank is quite cumbersome considering that one has to lift the shroud to a required height and affix it at that height for a period of time, properly disconnect an empty portable liquid propane tank from a fuel supply line, remove the empty portable liquid propane tank out of a housing chamber, place a fully charged liquid propane tank into a tank housing chamber, properly connect the fully charged portable liquid propane tank to the fuel supply line of the heater, then lower the shroud to sit on the base of the heater to protect the portable liquid propane tank and the fuel supply line from outside elements.

There is a potential danger of this slidable shroud type of heater during the portable liquid propane tank installation and removal services. When installing or removing the portable liquid propane tank, the slidable shroud has to be held in suspense for a sustained period of time, either by a second pair of hands of an assistant or by suspending hooks, hanger or other supports. Should the second pair of hands accidentally drop the shroud, or should a gust of wind or unintended movement that causes the shroud to fall from associate hooks, hangers or other supports, any impact due to the fallen shroud may cause a spark that may ignite any leaked propane gas from the fuel line or from the portable liquid propane tank. Therefore, the safety and ease of placement and removal of the tank and ease of making correct and proper connection and disconnection to and from the fuel line are of critical importance. The present invention overcomes the above-mentioned difficulties and safety concerns by providing a new and improved design of the heater.

SUMMARY OF THE INVENTION

The first object of the present invention is to enhance safety of the installation and removal of a portable liquid propane tank from an all around radiation heating apparatus.

The second object of the present invention is to ensure a safe and easy handling of a portable liquid propane tank to and from an all around radiation heating apparatus.

The third object of the present invention is to arrive at a liquid propane tank housing chamber with an open-able and closable door.

The fourth object of the present invention is to arrive at an all around radiation heating apparatus with a liquid propane tank housing chamber wherein a door is approximately between a half and a third of the diameter of the housing chamber.

The fifth object of the present invention is to arrive at an all around radiation heating apparatus without a slidable shroud.

The sixth object of the present invention is to arrive at an all around radiation heating apparatus with a door having an elongated oval and curve opening to serve as an observation opening to visually inspect whether a portable liquid propane tank is installed in the housing chamber without having to open the door itself.

The seventh object of the present invention is to arrive at an all around radiation heating apparatus with a door having an elongated oval and curve opening to serve as a handle to open and close the door.

The eighth object of the present invention is to arrive at an all around radiation heating apparatus with a door having a top ridge and a bottom ridge serving as alignment references for the correct placement of the door to the door frame of the housing chamber.

The ninth object of the present invention is to arrive at an all around radiation heating apparatus with attached wheels for ease of transportation of the heater.

The tenth object of the present invention is to arrive at an all around radiation heating apparatus with a portable liquid propane tank housing chamber that is sufficiently structured to support the weigh accumulated from above the housing chamber.

The eleventh object of the present invention is to arrive at an all around radiation heating apparatus with a portable propane tank housing chamber that is sufficiently structured with balanced weight distribution to stabilize the heater even if a portable liquid propane tank is not installed.

The twelfth object of the present invention is to introduce a tabletop to the all around radiation heating apparatus.

The thirteenth object of the present invention is to provide channels for ventilation to allow propane gas to escape in case there is a leak of propane gas.

The fourteenth object of the present invention is to provide a plurality of stabilizers to the all around radiation heating apparatus to prevent unintended tipping over.

The fifteenth object is to provide a weight chamber to the base of the all around radiation heating apparatus to lower its center of gravity to further prevent unintended tipping over.

DETAIL DESCRIPTION OF THE INVENTION

Figure 1:
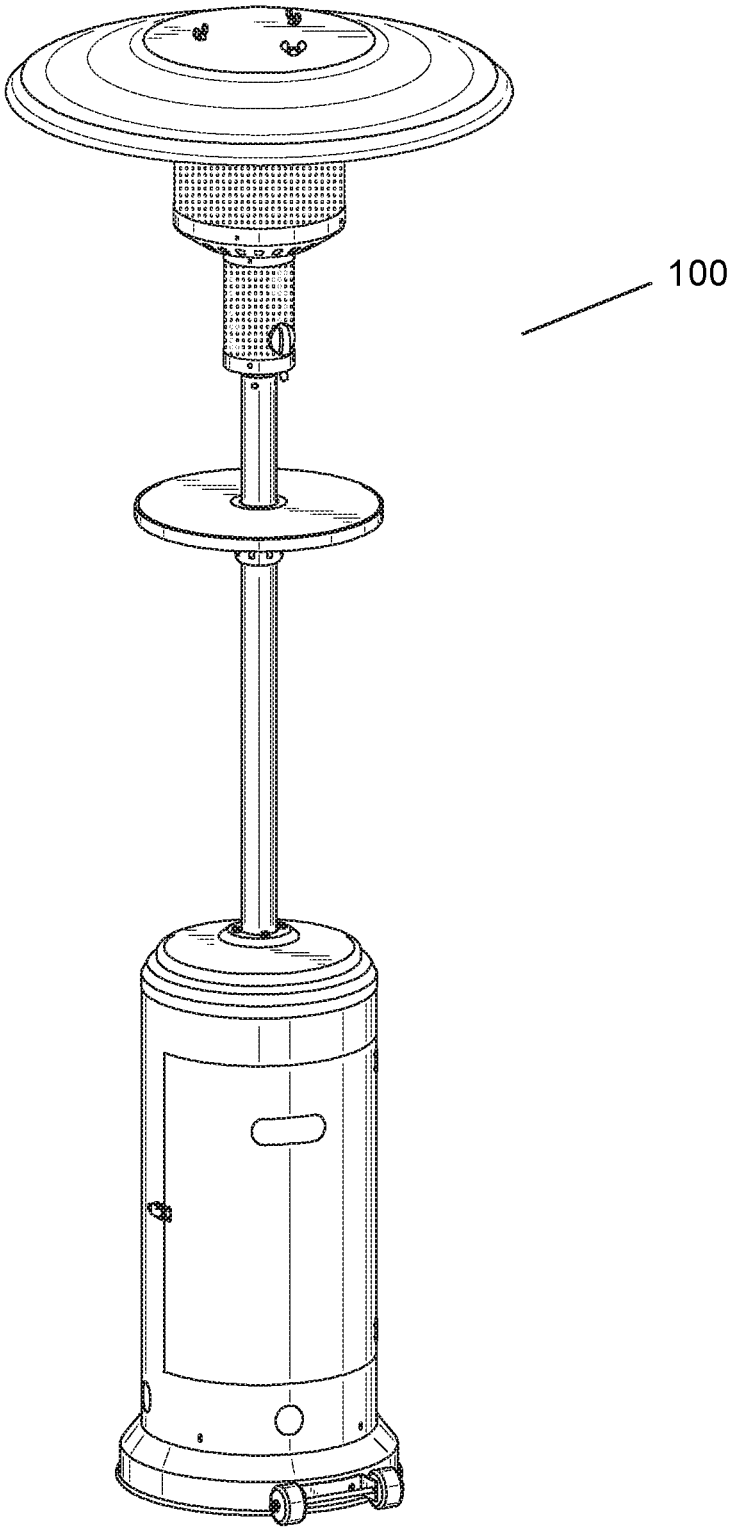
FIG. 1 is a perspective view of the all around radiation heating apparatus having its door in a close position.
Figure 2:
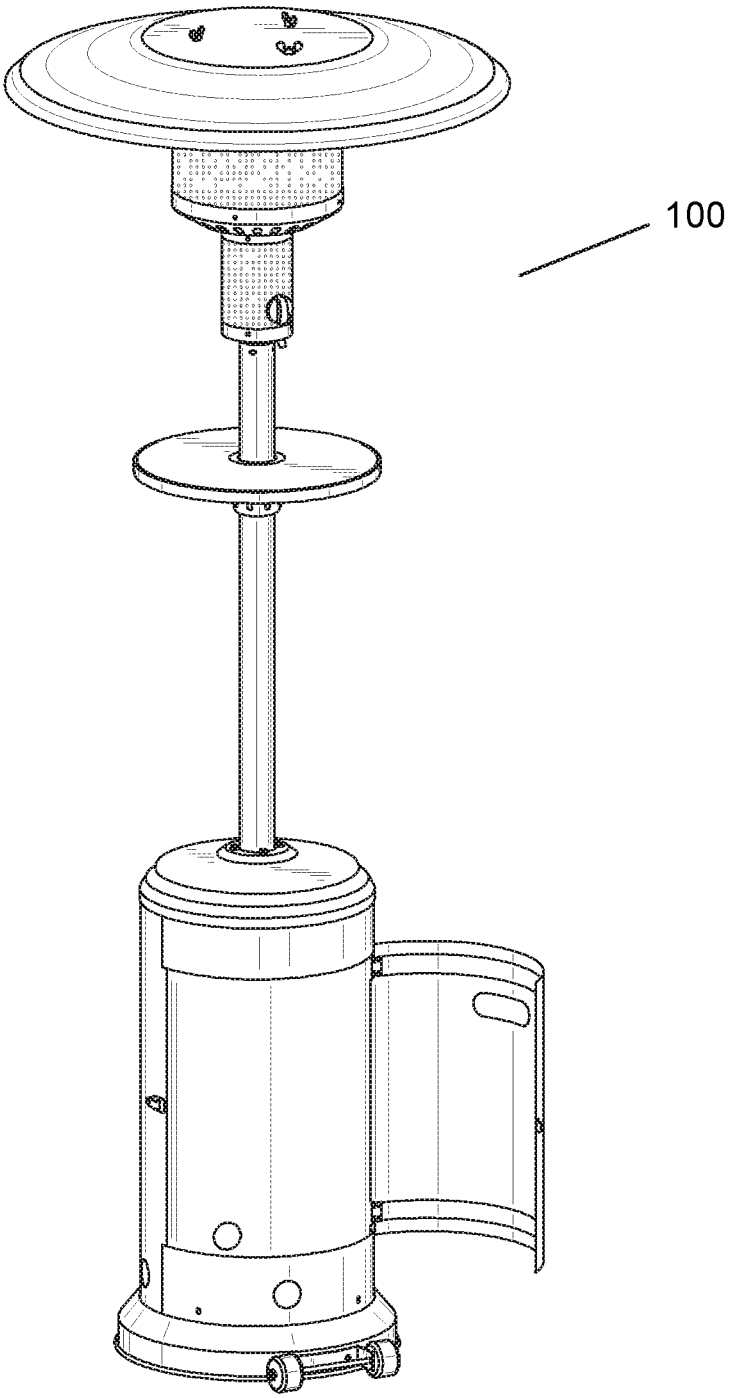
FIG. 2 is a perspective view of the all around radiation heating apparatus having its door in an open position.

FIGS. 1 and 2 show by way of an example a fully assembled all around radiation heating apparatus 100 in perspective views. FIG. 1 shows a heating apparatus with a door closed and FIG. 2 shows the heating apparatus with the door opened.

Figure 3:
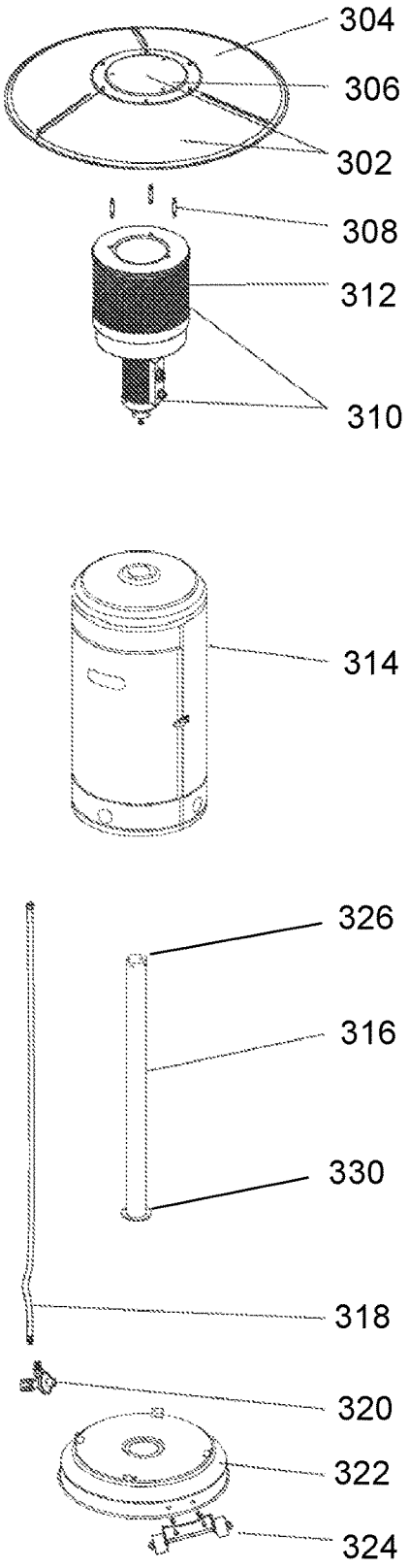
FIG. 3 is an exploded view of the all around radiation heating apparatus.

Numerous parts of the all around radiation heating apparatus are shown in an exploded view in FIG. 3. Heater 100 includes a reflector assembly 302 made of three reflector panels 304 and a reflector plate 306, a plurality of reflector studs 308, a head assembly 310 including a heat burner with screen exterior 312, a cylindrical housing assembly 314, a post 316, a gas hose 318, a gas regulator 320, a base 322 and a set of wheels 324.

Figure 4:
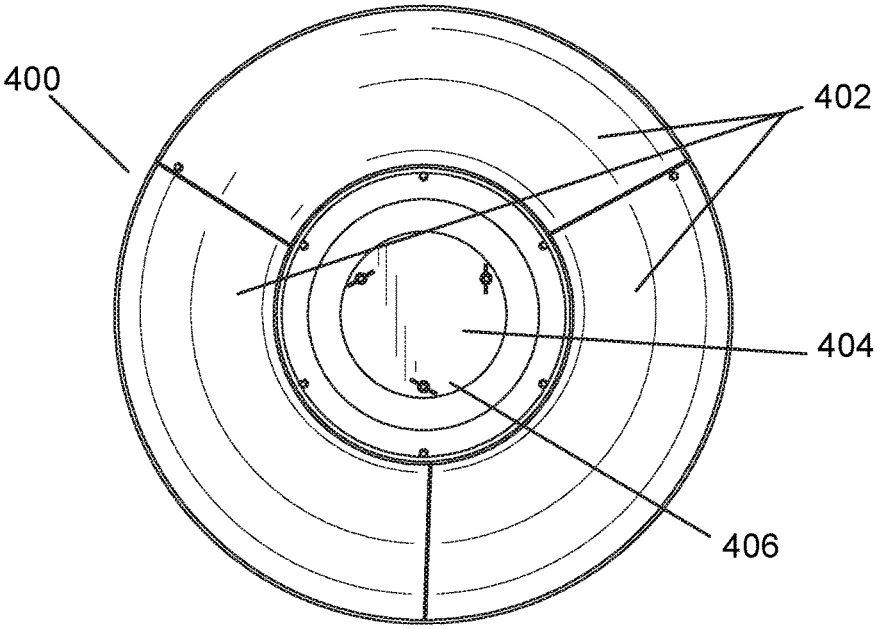
FIG. 4 is a multi-panel reflector assembly in fully assembled form.

FIG. 4 shows the reflector assembly in fully assembled form. The purpose of reflector assembly 400 is to evenly disseminate rising heat generated from the head assembly 310 to the peripheral surroundings of the all around radiation heating apparatus. In this embodiment, the reflector assembly is made of three reflector panels 402 when interconnect form a circular and concave disk shape as shown in FIGS. 1-3. The reflector assembly is fully completed when reflector plate 406 is installed therein the center hole of the assembled three reflector panels 402. The advantage of the multi-panel design is ease of compact packaging for shipping purposes. How a multi-panel reflector looks once installed on an all around heating assembly is shown by way of an example in FIG. 19.

Figure 5:
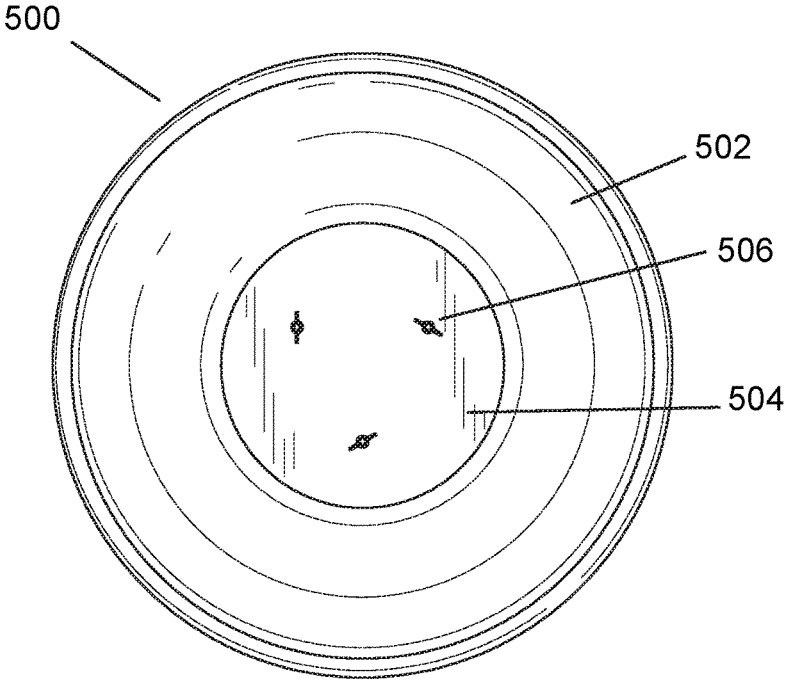
FIG. 5 is a unibody panel reflector in fully assembled form.

FIG. 5 shows an alternate embodiment of a reflector assembly 500. It has the same circular and concave disk shape of reflector assembly 400, except it is not made of a multi-panel reflector, it is made of a unibody panel 502 with a separately installed reflector plate 504 in the center. The advantage of this unibody panel design is ease of manufacturing and final installation.

The heater burner with screen exterior 312 is connected to the reflector assembly 302 by a set of reflector studs 308 and with corresponding number of wing-nuts 406 and 506, as shown by way of examples in FIGS. 4-5. The exact number of studs and wing-nuts may change depending on considerations of ease of installation at the beginning of the season of use and disassembly at the end of the season of use, the ability to withstand windshield factors in outdoor use, etc.

Figure 6:
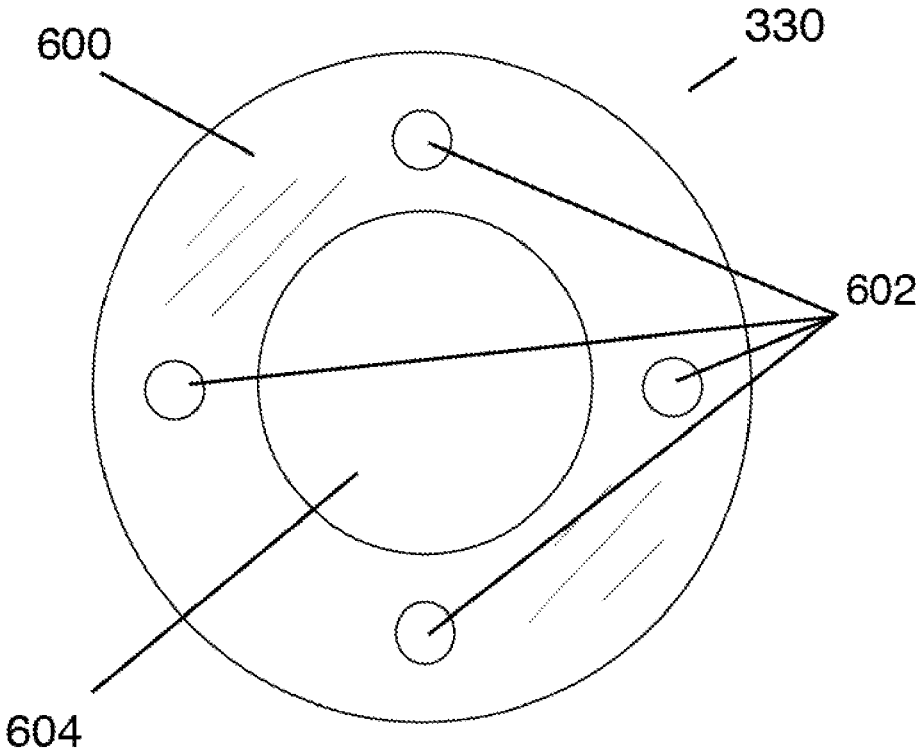
FIG. 6 is a close-up view of the bottom flange section of a post.

Post 316 has a bottom flange section 330 and a top opening section 326. Enlarged views of the bottom flange section 330 is shown by way of an example in FIG. 6 where it is shown that the flange section 330 has a plurality of head fastening holes 602 and a conduit opening 604.

Figure 7:
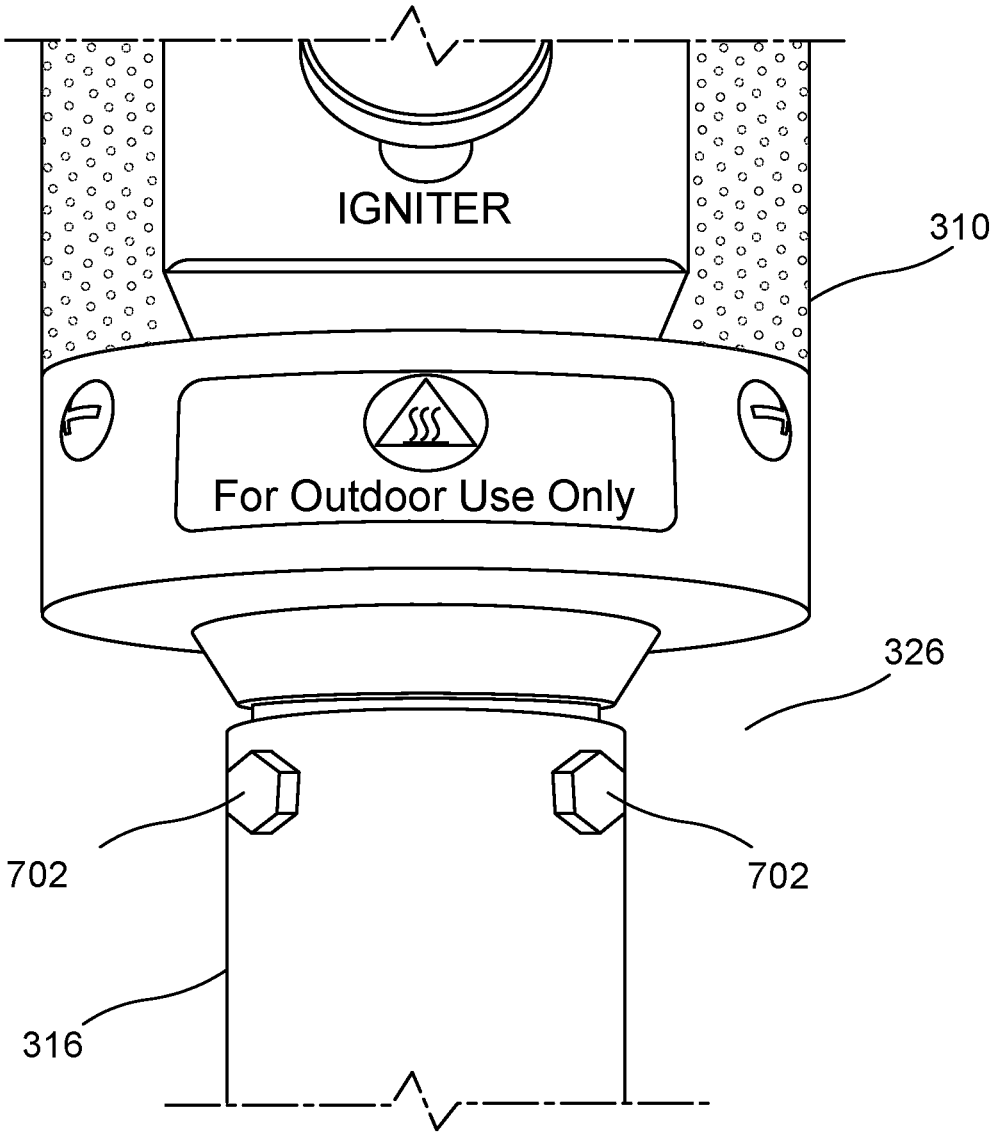
FIG. 7 is a close-up view showing a burner securely affixed to a bottom section of the post.

Enlarge views of the top opening section of post 316 is shown by way of an example in FIG. 7 where there are a plurality of holes 702. The heater burner with screen exterior has a plurality of side holes 902 is shown by way of an example in FIG. 9 that would correspond in location with the plurality of head fastening holes 702. When the lower section of the heater-burner is inserted into the top opening of post 316, the plurality of holes 902 of the burner and the plurality of head fastening holes 702 can be aligned so as to permit a plurality of screw nuts 904 to secure the heater 312 to the post 316, is shown by way of an example in FIG. 7.

Figure 8:
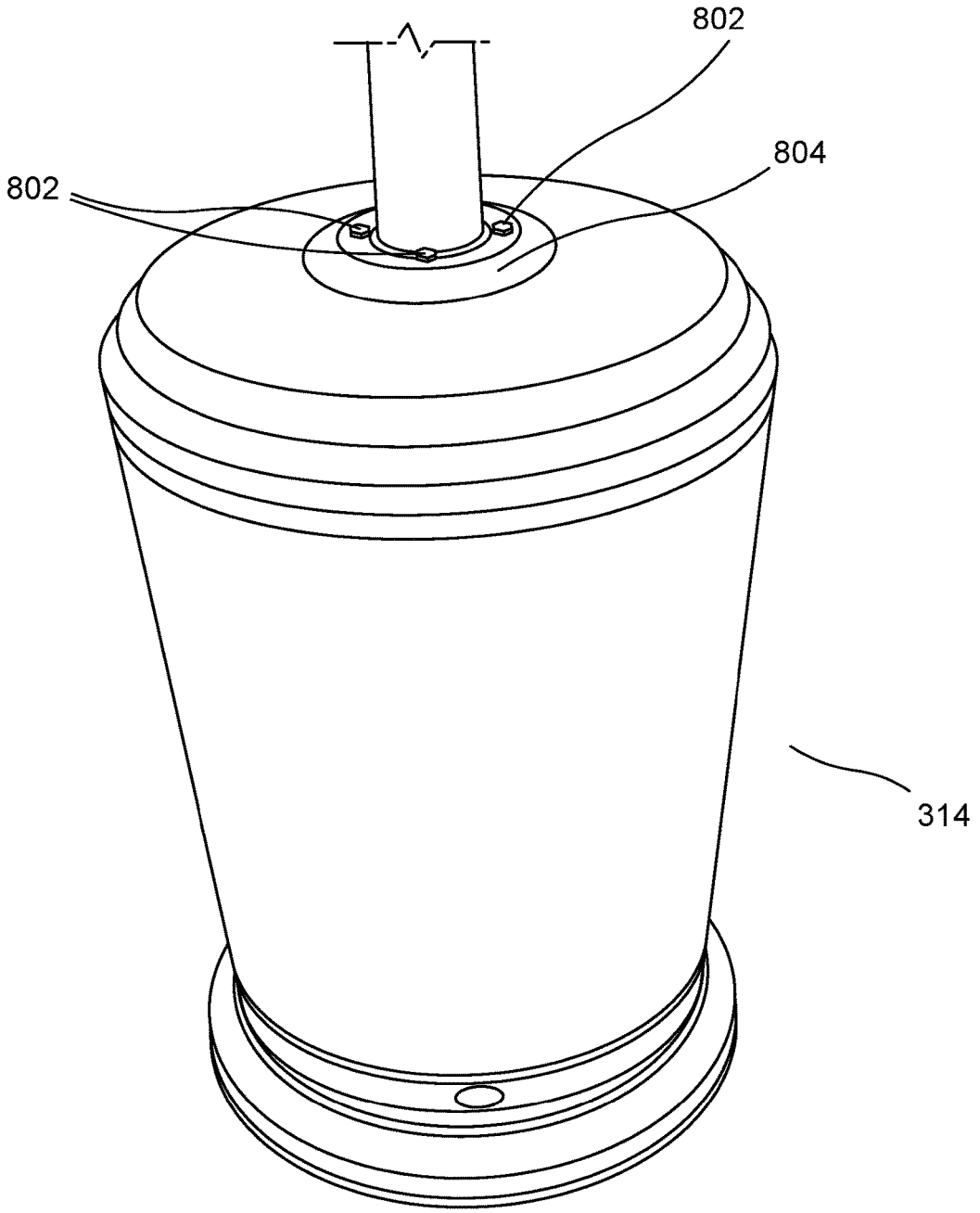
FIG. 8 is a close-up view showing a post securely affixed to a housing cylinder.

The flange 330 is used to securely seat the post 316 to the top section of cylinder housing 314. On the top section of cylinder housing 314 is an opening 315 suitably allow the post 316 to fit from underneath there-through as shown in FIG. 8. A protruded retainer 804 is raised above the surrounding top surface of the cylinder to suitably accommodate the flange 330 for an aligned fitting. The protruded retainer 804 has a plurality of holes 802 that can correspondingly align with the plurality of holes 602 so as to allow a plurality of screw nuts to fit there-through to securely affix post 316 to the housing cylinder 314.

Figure 9:
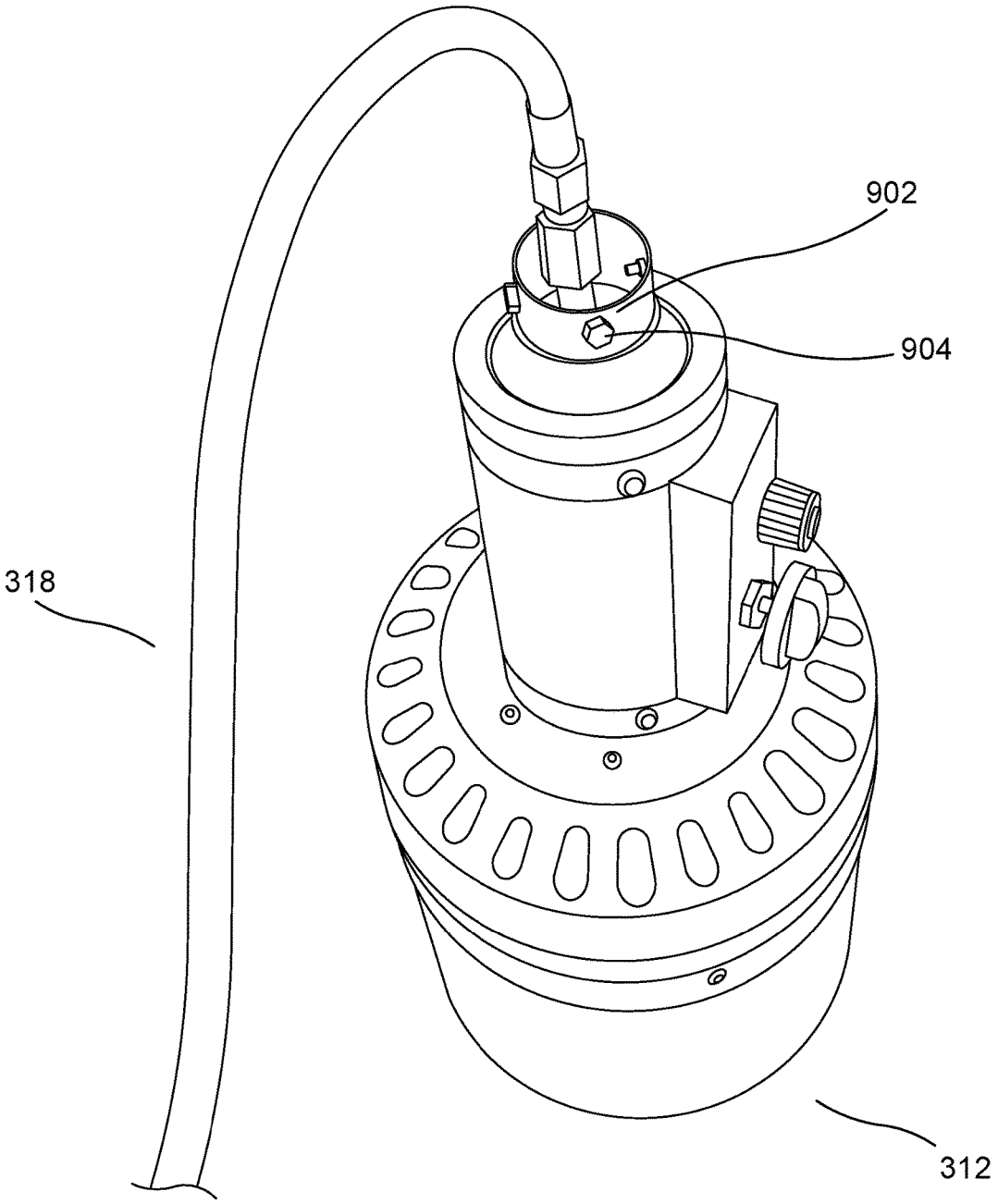
FIG. 9 shows a fuel supply line connected to a heater burner.

A fuel line 902 travels inside and along the conduit opening 604 of post 316 to supply propane gas from a portable tank residing in the housing cylinder to the heater burner 312, as shown in FIG. 9.

Figure 10A:
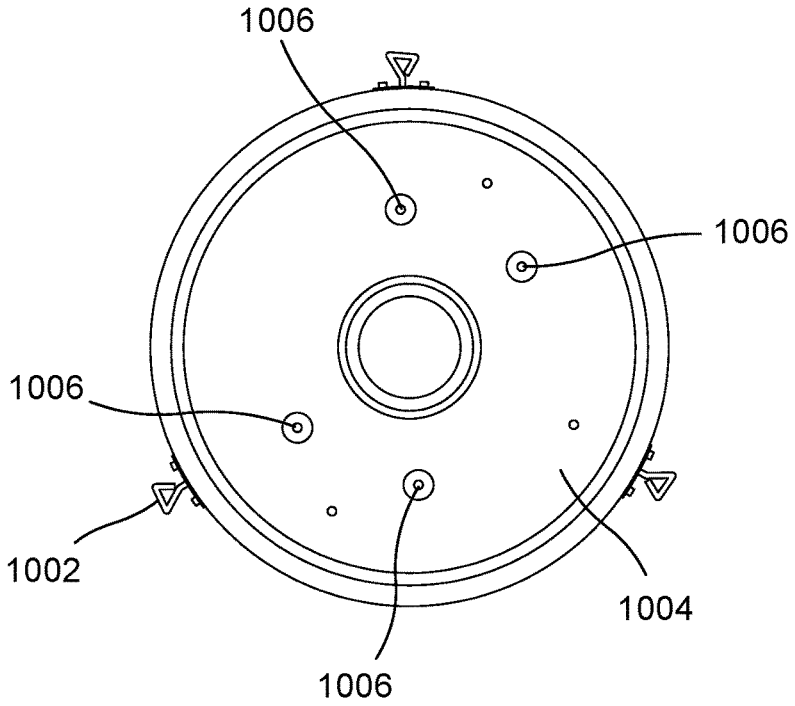
FIG. 10A shows a top view of a base with stabilizers installed on the all around radiation heating apparatus.
Figure 10B:
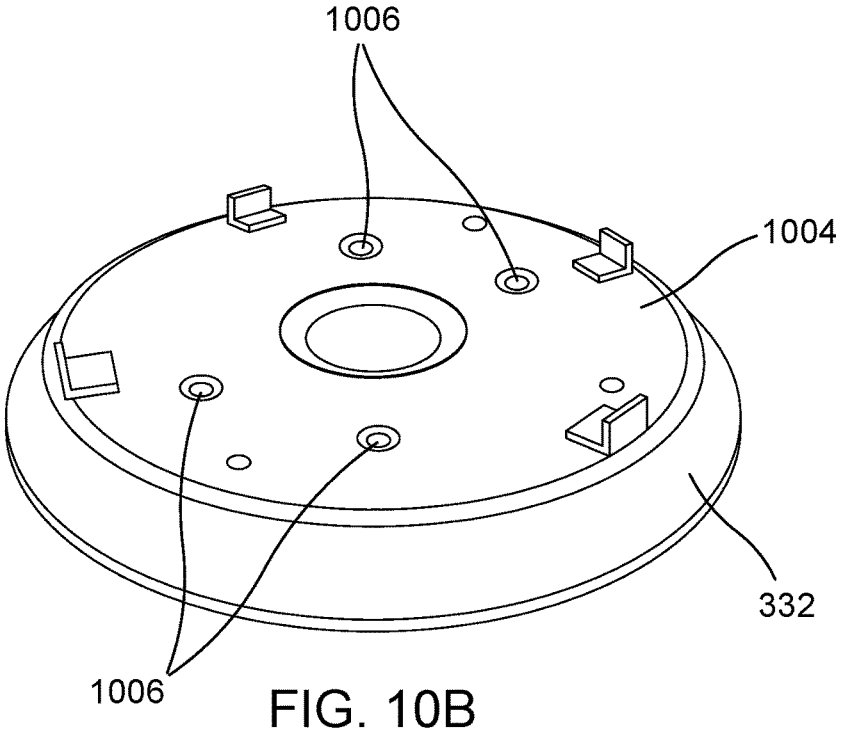
FIG. 10B shows a perspective view of another base without any stabilizers installed thereon and having a number of L brackets installed on the top surface of the base.

A more detail top view of base 332 is shown by way of examples in FIGS. 10A and 10B. Around the perimeter of base 322 is a number of base toes 1002 for providing further stabilization to the heater. Under normal usage, the base alone provides sufficient stabilization to the all around radiation heating apparatus. However, under high wind situations, base toes 1002 would further prevent the all around radiation heating apparatus from tipping over. The base toes 1002 are installed onto the exterior surface of the base 322 by screws.

Figure 11:
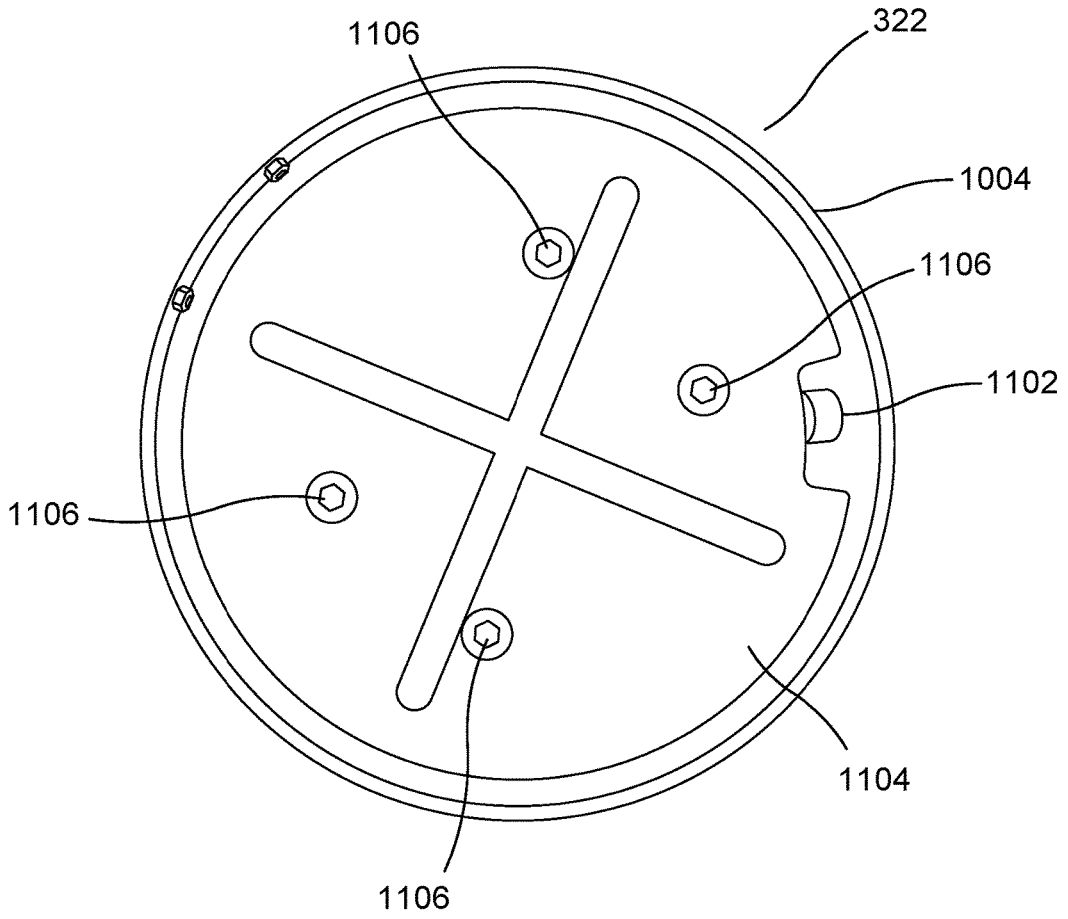
FIG. 11 shows a bottom view of a weight chamber installed underneath the base of the all around radiation heating apparatus.

Securely placed underneath the top cover 1004 of the base 322 is a weight chamber 1104 is shown by way of an example in FIG. 11. The weight chamber 1104 has a screw cap 1102. The weight chamber is meant to be filled with either water, sand or other objects so as to create a low center of gravity for the all around radiation heating apparatus. A filled-in weight chamber is used instead of permanent weight to make shipment and re-location of the all around radiation heating apparatus less costly and more convenient.

As shown, the weight chamber 1104 is attached to the top cover 1004 to form the base 322 by fitting a number of screws through a set of holes 1006 of the top cover 1004 corresponding with a set of holes 1106 of the weight chamber 1104.

Figure 12:
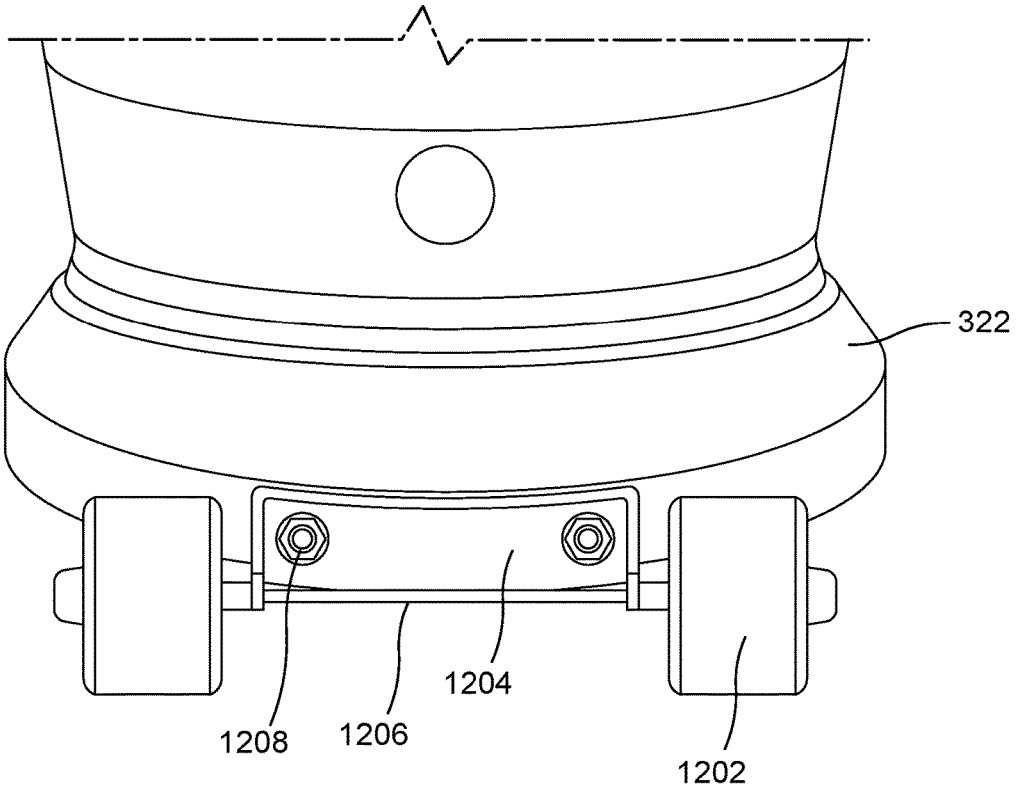
FIG. 12 shows a pair of wheels installed on the base of the all around radiation heating apparatus.

FIG. 12 shows a pair of wheels 1202 mounted on a mounting bracket 1204 via a shaft 1206 fully installed on the base 322 via screw-in bolts and nuts 1208. This set of wheels provides convenient means of transporting the all around radiation heating apparatus.

The set of wheels 324 and a plurality of toes can both be installed on a base 322. This combination of installations would provide the optimum stabilization effect as well as transport convenience.

Figure 13:
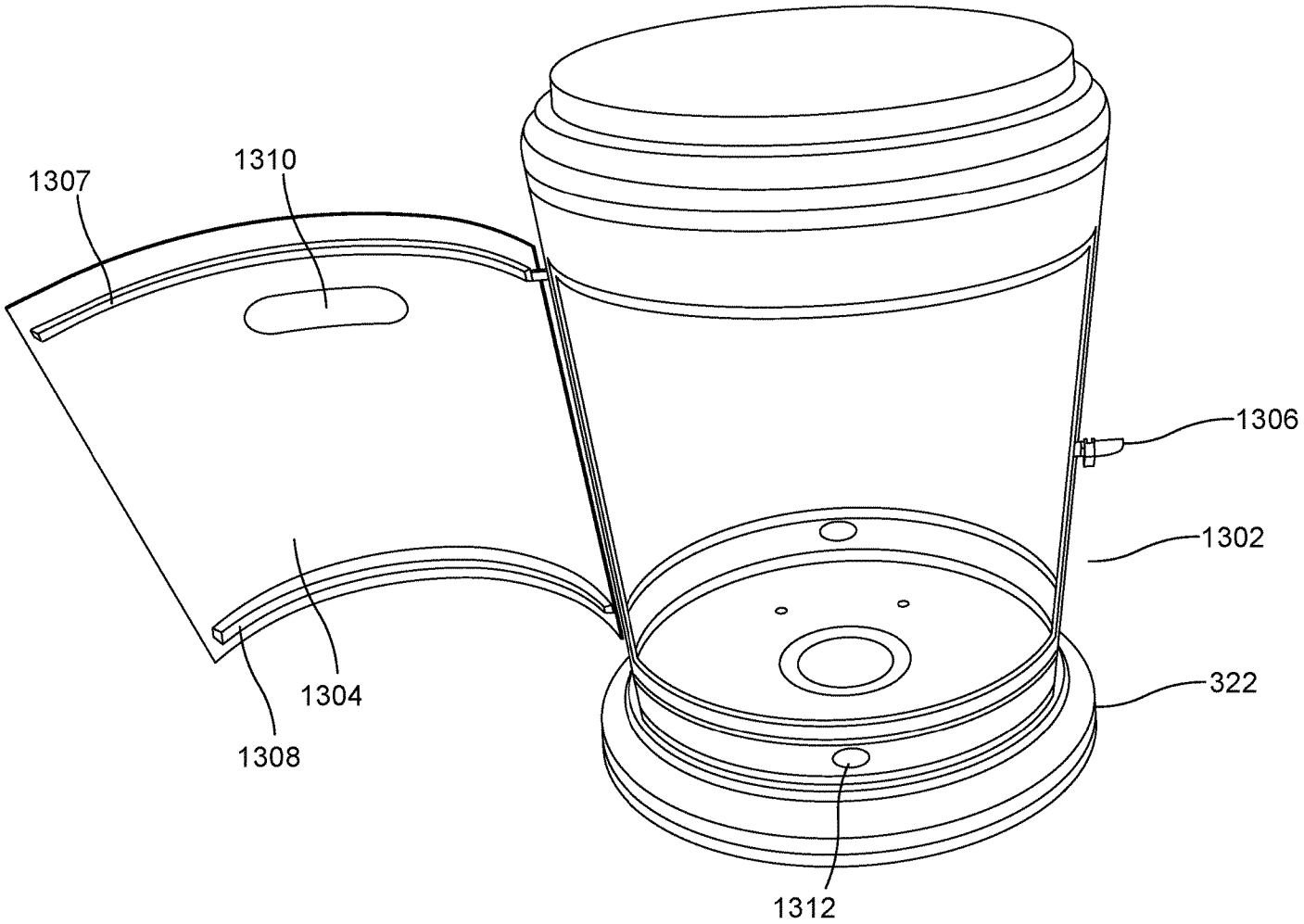
FIG. 13 shows a shell of the housing cylinder mounted on a base of the all around radiation heating apparatus.
Figure 14:
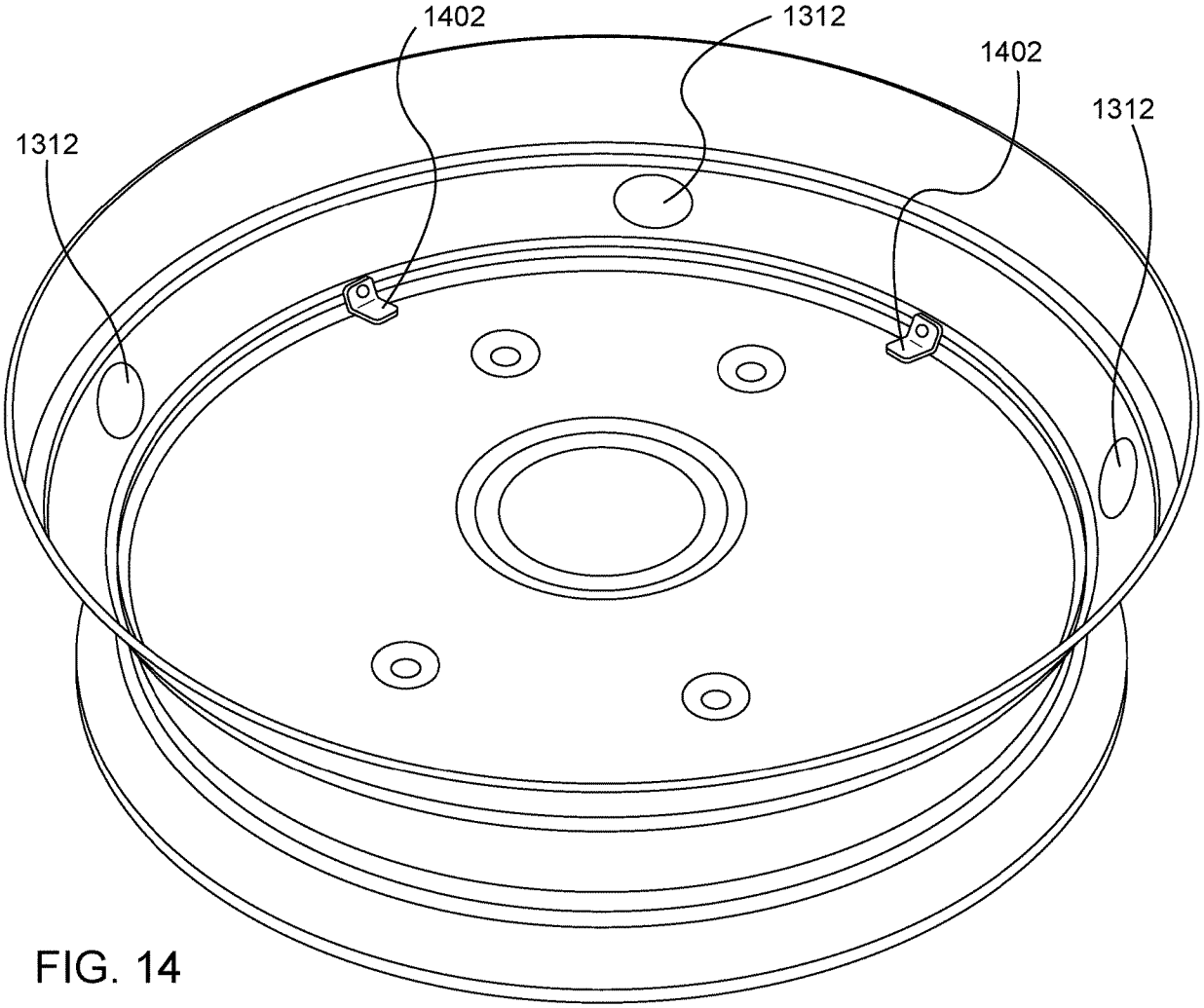
FIG. 14 shows a detail view of the interconnection between the base and the shell of the housing cylinder of the all around radiation heating apparatus.
Figure 15A:
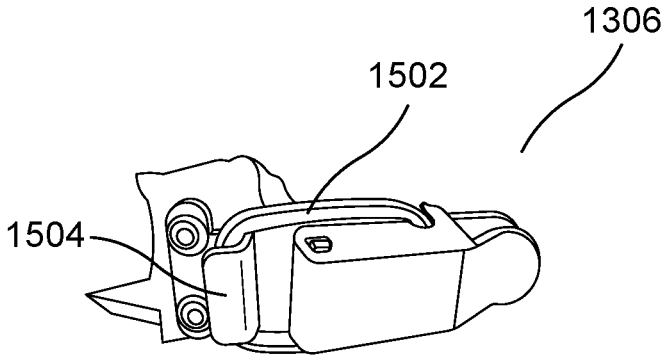
FIGS. 15A, 15B, 15C and 15D show a number of detail views of the latching mechanism that secures a door to a shell of the housing cylinder.
Figure 15B:
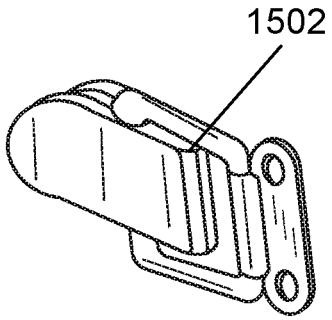
Figure 15C:
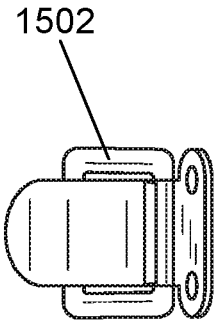
Figure 15D:
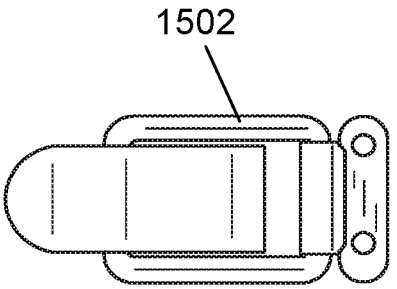
Figure 16:
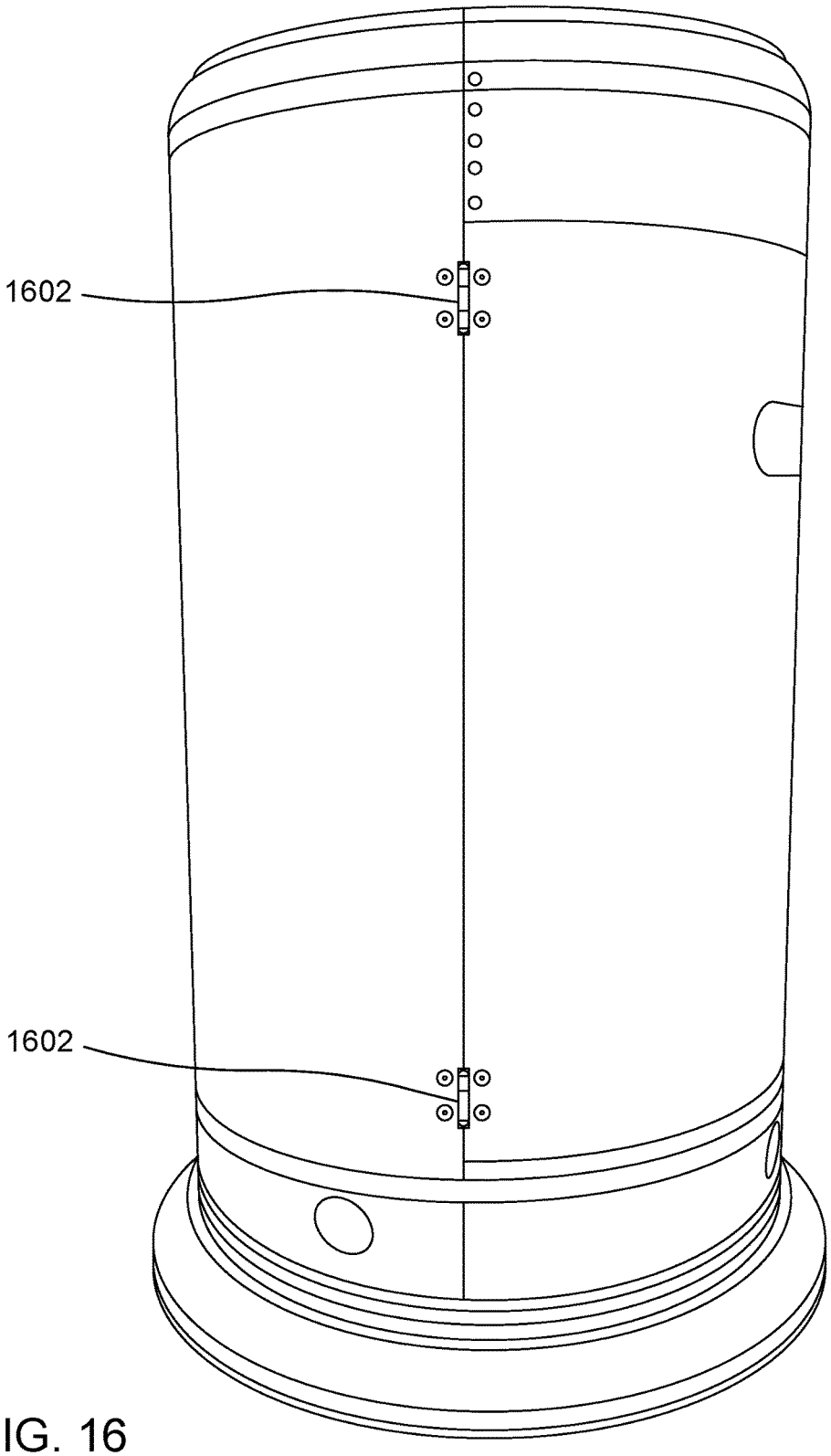
FIG. 16 shows a view of the chamber of the all around heater featuring the door hinges.

FIG. 13 shows that a shell 1302 of housing cylinder 314 fully installed on base 322. FIG. 14 shows a more detailed view of how shell 1302 is installed on the base 322 via a plurality of L brackets 1402 and bolts and nuts. In the exemplary view given here, the door 1304 is installed in such a way that it is mounted on a side of the shell where it swings open clockwise via a pair of hinges 1602 as shown by way of an example in FIG. 16. The door 1304 and its hinges 1602 may be installed on the other side of the shell so the door swings open counter-clockwise. The door 1304 has a pair of top and bottom ridges 1307 and 1308 to provide proper alignment with a door frame of the shell 1302 when the door 1304 is fully closed.

Once closed, the door is locked into place by latching a strap-loop 1502 of a strap lock 1306 over a hook 1504 on the door 1304, as shown in FIG. 15. In this example given, the hook 1504 is installed on the door, and the strap-loop 1502 and the strap lock 1306 is installed on the body of shell 1302. This arrangement may be reversed in that the hook 1504 may be installed on the shell 1302, and the strap-loop 1502 and the strap lock 1306 may be installed on the door.

The door frame itself has an opening spanning 130 degrees of the 360 degrees circumference of the shell 1302. The door is designed to cover approximately 139 degrees of the 360 degrees circumference of the shell 1302. This degree of door frame opening is an optimal amount to provide ease of transporting a portable liquid propane tank into and out of the housing cylinder yet to ensure the overall integrity of the housing cylinder given the weight it has to withstand and distribute downward to the base.

It is learned that if the degree of circumferential coverage of the door frame were greater than 130 degrees, there would be uneven downward weight distribution that pre-disposes the all around radiation heating apparatus an unacceptable tendency to tip over. However, if the degree of circumferential door frame coverage is smaller than 130 degrees, the opening is too small to transport the propane tank into and out of the housing cylinder.

On the door 1304 is an elongated oval opening 1310 serving both as an easy visual inspection window to check whether a propane tank is in the housing cylinder as well as serving as a handle to conveniently open and close the door 1304.

In addition to the above-mentioned purposes, the elongated oval opening 1310 and a plurality of openings 1312 in combination serve as safety ventilations system. As it is readily understandable that propane gas may leak from the liquid propane tank if there is any crack or crevices to an otherwise sealed system. If and when a leak does occur, instead of trapping the escaped and highly flammable gas in the cylindrical housing chamber 314, it is much better to provide an outlet for the gas to escape. Propane gas has a density typically one and a half times higher than normal air. This means escaped propane gas would sink. For this reason, there are more openings and they are widely spread on the lower side of the shell 1302 than the opening at the higher side.

The all around radiation heating apparatus may be used in outdoor social environments, it would greatly enhance the heater's utility functions if a table of adjustable height may be added to hold drinks, serve as a writing pad or serve other features associated with a table. For this reason, a table-top may be added to the present invention.

Figure 17:
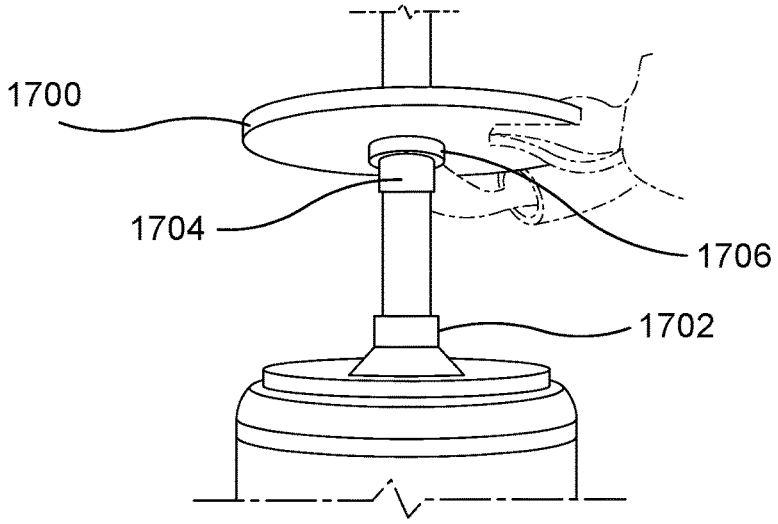
FIG. 17 shows a tabletop being installed on a shaft of the all around radiation heating apparatus.
Figure 18:
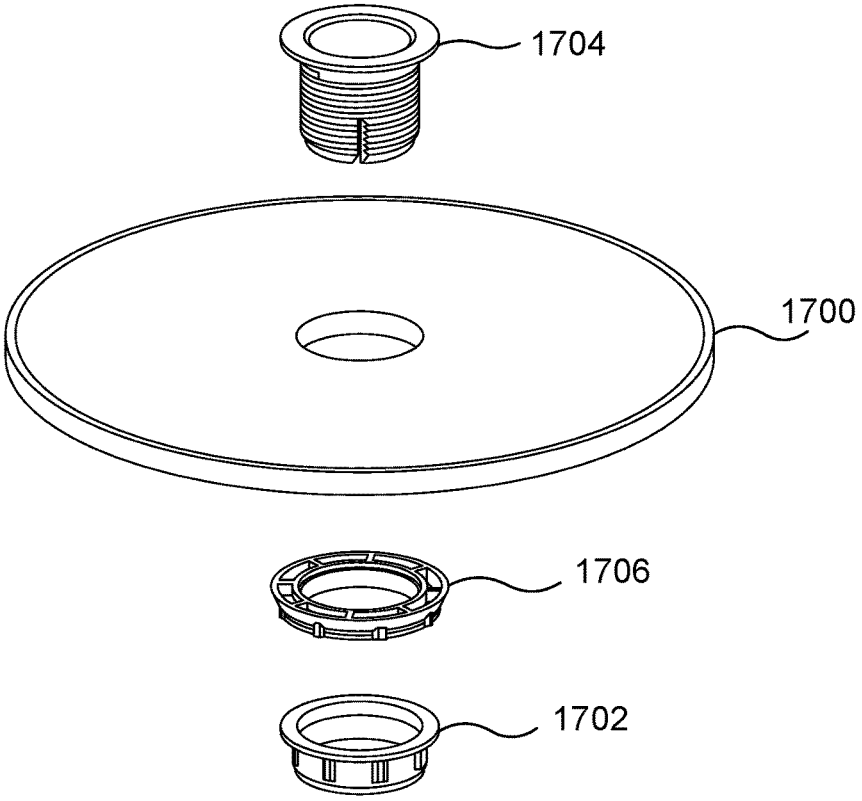
FIG. 18 is an expanded view shows the relationship between a top mounting piece, a tabletop, a stopper, a bottom mounting piece and a post of the all around radiation heating apparatus.

An example of an installed table-top is shown by way of examples in FIGS. 17-18. This table-top has a center hole allowing insertion of the table-top 1700 onto the post 316. The table-top 1700 is held in place via friction fit by a complementary pair of mounting fasteners with a bottom nut piece 1702 and a top screw piece 1704 with a stopper 1706 situated there-in-between, everyone of which has a center hole though they may have different sizes. To install this table-top 1700 to the all around radiation heating apparatus, the heater burner 312 should be removed from post 316. The bottom nut piece 1702, the stopper 1706, the table-top 1700 and the top screw piece 1704, should be inserted into post 316 via their respective center holes having the table-top 1700 and stopper 1706 sandwiched there-in-between. As shown, the top screw piece 1704 is of a cylindrical shape with exterior screw threads having a unibody top flange. The bottom nut piece 1702 is also of a cylindrical shape with interior threads complimentary to the exterior threads of the top screw piece 1704 and exterior friction hand gripes. The center hole of the top screw piece 1704 is smaller in diameter than the center hole of the table-top 1700 and top screw piece 1704 actually fits into and through the center hole of the table-top 1700 until further insertion is stopped by the top flange of the top screw piece 1704. When it is determined that the table-top 1700 reaches a desired height level, the bottom nut 1702 is screwed into the thread of the top screw piece 1704. This screw-in action tightly squeezes the interior surface of the cylindrical section associated with the thread portion of the top screw piece 1704 against the surface of the post 316 so as to affix the table tightly in place.

Figure 19:
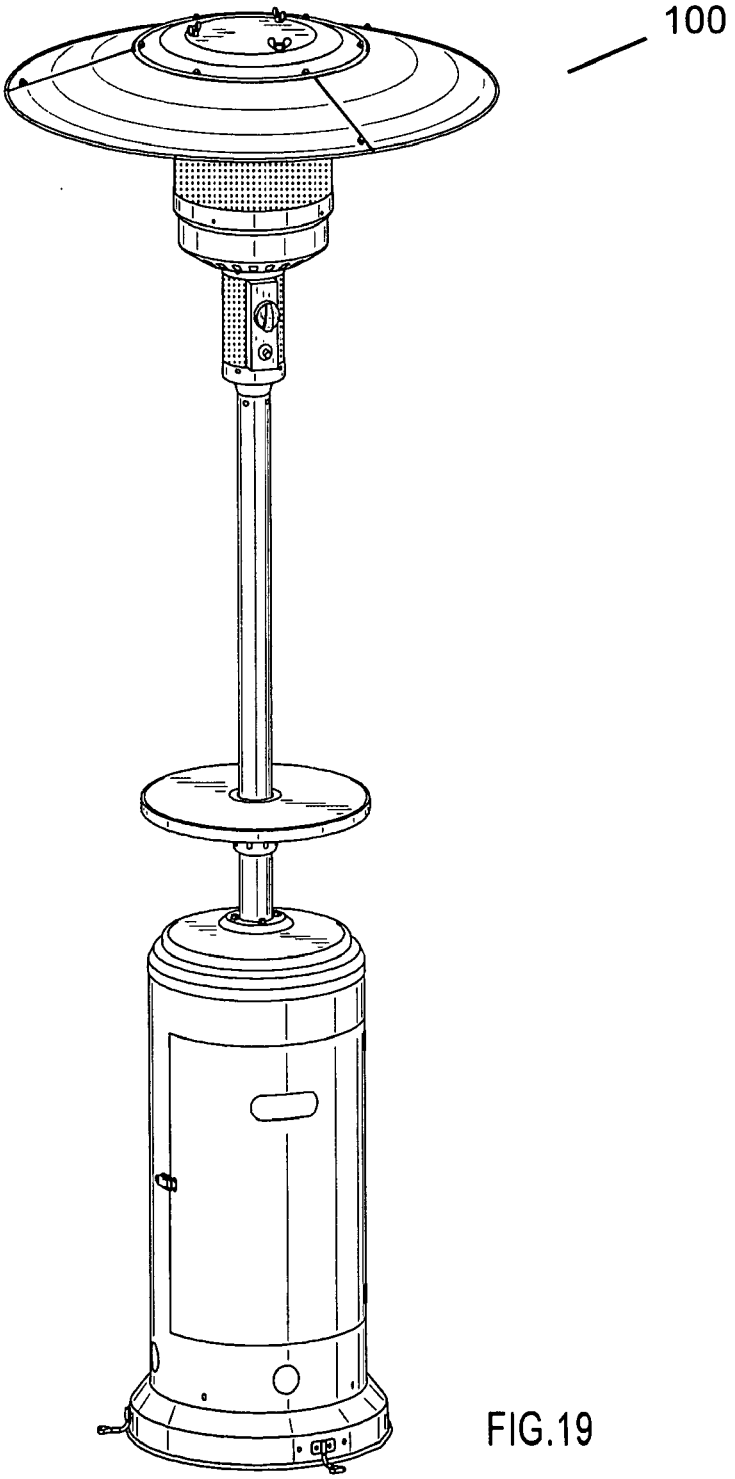
FIG. 19 shows an all around heater assembly with a number of stabilizers installed on the heater assembly and the tabletop is set to a low position.

FIG. 19 shows an all around heating assembly with the table-top placed in a low position. In this figure, a fully installed base stabilizer version of the heating assembly is shown.

The invention claimed is:

1. An all-around radiation heater, comprising:

a reflector panel;

a heat burner;

a post;

a cylindrical housing assembly with a door having a same radius of curvature as the cylindrical housing assembly;

a cylindrical base;

a weight chamber; and a set of wheels installed on to the base with a brace having a same radius of curvature as that of the cylindrical base; and a set of base toes installed on an exterior surface of the cylindrical base and are spaced equal distance apart from each other to prevent the all-around radiation heater from tipping over;

wherein the reflector is removably attached to the heat burner; the heat burner is removably attached to a top portion of the post; a low portion of the post is removably attached to the cylindrical housing assembly; the cylindrical housing assembly is removably attached to the base; and the weight chamber is removably attached to the cylindrical base.

2. The all-around radiation heater of claim 1, wherein the reflector panel comprises a plurality of partial panels of equal dimensions detachably surrounding a reflector plate.

3. The all-around radiation heater of claim 1, wherein the reflector panel is of a unibody structure detachably surrounding a reflector plate.

4. The all-around radiation heater of claim 1, wherein the reflector panel is removably attached to the burn heater via a plurality of wing-nuts.

5. The all-around radiation heater of claim 1, wherein the heat burner is attached to the top portion of the post by inserting a low portion of the heat burner into the top portion of the post then install a set of four bolt screws perpendicular to and penetrating into both the top portion of the post and the low portion of the heat burner; and wherein the set of screws are spaced equal distance apart from each other.

6. The all-around radiation heater of claim 1, wherein the low portion of the post comprises a flange perpendicular to a length of the post and the flange comprises a set of holes spaced equal distance apart from each other;

wherein a top surface of the cylindrical housing assembly comprises a set of four holes surrounding a central hole and spaced equal distance apart from each other;

wherein the post is removably secured to the cylindrical housing assembly by inserting the post into the top surface of the cylindrical housing assembly until the flange comes into contact of an underside of the top surface whereby upon aligning the set of holes of the flange with the set of holes of the cylindrical housing assembly, a set of screws are removably secured the post to the cylindrical assembly.

7. The all-around radiation heater of claim 1, wherein the base has a middle rim with a radius smaller than a bottom rim radius thus provide an endless side wall there-in-between with a slope.

8. The all-around radiation heater of claim 1, wherein the weight chamber comprises a closable opening for importing and exporting an amorphous weight substance.

9. The all-around radiation heater of claim 8, wherein the amorphous weight substance includes one of sand and water.

10. The all-around radiation heater of claim 1, wherein the weight chamber is secured to the base via a plurality of holes therein the weight chamber and the base to accommodate a plurality of fastener to fit there-through.

11. The all-around radiation heater of claim 7, the base further comprises a top rim raised above the middle rim and with a radius small than the radius of the middle rim; wherein a bottom portion of the cylindrical housing assembly could complimentarily sit in-between the top rim and the middle rim and the raised top rim could prevent the cylindrical housing assembly to slide away therefrom.

12. The all-around radiation heater of claim 11, further comprising a plurality of L-brackets installed adjacent the top rim and spaced equal distance apart from each other.

13. The all-around radiation heater of claim 12, wherein upon sitting the cylindrical housing assembly in-between the top rim and the middle rim of the base, a set of fasteners are installed perpendicular to a plurality of locations on an exterior surface of the cylindrical housing assembly and penetrating there-through both the plurality of locations of the exterior surface and the set of L-brackets.

14. The all-around radiation heater of claim 13, a gas hose is connected to the heat burner on one end and is connected to a gas regulator in the cylindrical housing chamber on another end.

15. The all-around radiation heater of claim 1, further comprising a set of wheels installed onto the base with a brace having a same radius of curvature as that of the cylindrical base.

16. The all-around radiation heater of claim 1, wherein the cylindrical housing assembly includes a number of holes serving as ventilation openings.

17. The all-around radiation heater of claim 1, wherein the door includes an elongated oval opening serving both as a door handle and a ventilation opening.

18. The all-around radiation heater of claim 1, wherein the door includes a top ridge and a bottom ridge situated on an interior side of the door to provide proper alignment of the door to a door frame of the cylindrical housing chamber.

19. The all-around radiation heater of claim 1, further comprising a strap latch situated on an exterior portion of the cylindrical housing chamber and a hook situated on an exterior surface of the door, wherein the door is securely shut when a loop of the strap latch is placed on the hook and the latch is placed in a lock position.

* * * * *